US007208054B2

(12) United States Patent
Nakazawa

(10) Patent No.: US 7,208,054 B2
(45) Date of Patent: Apr. 24, 2007

(54) CONCENTRATED SOLUTION FOR PREPARING A SURFACE CONDITIONER, SURFACE CONDITIONER AND METHOD OF SURFACE CONDITIONING

(75) Inventor: Toshiko Nakazawa, Tokyo (JP)

(73) Assignee: Nippon Paint Co., Ltd., Osaka (JP)

( * ) Notice: Subject to any disclaimer, the term of this patent is extended or adjusted under 35 U.S.C. 154(b) by 25 days.

(21) Appl. No.: 11/062,252

(22) Filed: Feb. 18, 2005

(65) Prior Publication Data

US 2005/0184276 A1 Aug. 25, 2005

(30) Foreign Application Priority Data

Feb. 20, 2004 (JP) ..... 2004-044564

(51) Int. Cl.

| | |
|---|---|
| ***C23C 22/78*** | (2006.01) |
| ***C23C 22/03*** | (2006.01) |
| ***C23C 22/07*** | (2006.01) |
| ***C23C 22/60*** | (2006.01) |
| ***C09K 3/00*** | (2006.01) |

(52) U.S. Cl. ..... 148/253; 106/14.12; 106/14.39; 106/14.44; 106/287.29; 148/243; 148/253

(58) Field of Classification Search ..... 106/14.12, 106/14.39, 14.44, 287.29; 148/243, 253, 148/254

See application file for complete search history.

(56) References Cited

FOREIGN PATENT DOCUMENTS

| | | |
|---|---|---|
| EP | 0117599 | 9/1984 |
| EP | 1378586 | 1/2004 |
| JP | 59-226181 | 12/1984 |
| JP | 63-157878 | 6/1988 |
| JP | 10-245685 | 9/1998 |
| JP | 2000-96256 | 4/2000 |
| JP | 2001-089869 | 4/2001 |
| WO | WO-98/39498 | 9/1998 |
| WO | WO-00/05066 | 2/2000 |

*Primary Examiner*—Anthony J. Green
(74) *Attorney, Agent, or Firm*—Jordan and Hamburg LLP

(57) ABSTRACT

A concentrated solution (liquid concentrate) for preparing a surface conditioner, a surface conditioner (a treatment solution for preparing a surface), which have the excellent stability of dispersion and a method of a surface conditioning using this surface conditioner are provided. The concentrated solution for preparing a surface conditioner contains zinc phosphate particles and has a pH of 3 to 12. The zinc phosphate particles are of $D_{50}$ 3 μm or less and the concentrated solution for preparing a surface conditioner contains a laminar clay mineral.

5 Claims, 1 Drawing Sheet

CONCENTRATED SOLUTION FOR PREPARING A SURFACE CONDITIONER, SURFACE CONDITIONER AND METHOD OF SURFACE CONDITIONING

TECHNICAL FIELD

The present invention relates to a concentrated solution for preparing a surface conditioner, a surface conditioner and a method of surface conditioning.

BACKGROUND ART

Automobile's bodies, household electrical appliances or the like are commercialized by forming metal moldings from metal materials such as a steel sheet, a galvanized steel sheet, an aluminum alloy or the like, coating and assembling. Coating of such metal moldings are conducted after performing various steps such as degreasing, surface conditioning, chemical conversion treatment, and electrodeposition.

Surface conditioning is a treatment applied in such a way that a coat consisting of phosphate crystals is formed uniformly and quickly with a high density on the whole surface of metal in chemical conversion treatment of a phosphate coat of the subsequent step, and a treatment in which crystal nuclei of phosphate are generally formed on the metal surface by immersing a metal in a surface conditioning tank.

For example in Japanese Kokai Publication Sho-59-226181, there is disclosed a method of pretreating a metal surface, characterized by pretreating a metal surface by a prewash bath including titanium phosphate dispersed finely or tertiary zinc phosphate and montmorillonite, dispersed finely, prior to phosphating by a zinc phosphate solution. Technology disclosed therein is a method of sustaining an effect of a prewash bath for a long time.

However, a sustained effect of a prewash bath disclosed therein represents the stability of dispersion in a treatment bath of a dilute surface conditioner which is employed in a surface conditioning (pretreatment) and it cannot be said that the stability of dispersion in the concentrated solution (liquid concentrate) for preparing a surface conditioner is sufficient. With respect to a surface conditioner, it is generally stored in the form of a concentrated solution for preparing a surface conditioner and adjusted to a surface conditioner of a predetermined concentration by diluting the concentrated solution for preparing a surface conditioner in using it (in conducting the surface conditioning actually).

When the stability of dispersion of the concentrated solution for preparing a surface conditioner is not high, some ingredients such as zinc phosphate particles in the concentrated solution may precipitate and flocculate during storage. When the ingredients in the concentrated solution have precipitated and flocculated, the concentrated solution needs to be first stirred to homogeneously disperse the ingredients in the solution in adjusting a surface conditioner by diluting the concentrated solution. And, there maybe cases where the ingredients cannot be homogeneously dispersed even by stirring depending on the extent of precipitation and flocculation.

That is, when the stability of dispersion of the concentrated solution for preparing a surface conditioner is not high, a problem that a work of stirring and dispersing the concentrated solution becomes necessary or it becomes impossible to attain a desired effect of a surface conditioning because the ingredients cannot be homogeneously dispersed even by stirring may arise. Therefore, it is desired to develop a substance which is superior not only in the stability of dispersion of the surface conditioner but also in the stability of dispersion of the concentrated solution for preparing a surface conditioner.

And, in Japanese Kokai Publication Hei-10-245685, there is disclosed a pretreatment solution for conditioning a surface before applying chemical conversion treatment of a metal phosphate coat, which contains one or more species selected from phosphate containing at least one species of bivalent or trivalent metals including particles having a particle diameter of 5 μm or less, alkali metal salt or ammonium salt or a mixture thereof, and at least one species selected from the group of oxide fine particles bearing anionic charges and dispersed, an anionic water-soluble organic polymer, a nonionic water-soluble organic polymer, an anionic surfactant and a nonionic surfactant, and is adjusted to pH 4 to 13.

Further, in Japanese Kokai Publication 2000-96256, there is disclosed a treatment solution for conditioning a surface before applying chemical conversion treatment of a phosphate coat, which contains particles of one or more species of phosphate selected from phosphate containing one or more species of bivalent and/or trivalent metals and further contains (1) one or more species selected from monosaccharides, polysaccharides and derivatives thereof, or (2) one or more species of orthophosphoric acid, polyphosphoric acid or organic phosphonic acid compounds, or (3) one or more species of water-soluble high polymer compounds which consists of polymer of vinyl acetate, its derivative or copolymer of monomer being copolymerizable with vinyl acetate and vinyl acetate, or (4) polymer or copolymer obtained by polymerizing at least one species selected from specific monomers or α, β unsaturated carboxylic acid monomers, and monomer being copolymerizable with the above monomer in an amount of 50% by weight or less.

However, a treatment solution for surface conditioning disclosed therein is low in the stability of dispersion in a treatment solution, particularly in the stability of dispersion in a concentrated treatment solution. And, even when an inorganic dispersant is used, the stability of dispersion of the concentrated solution for preparing a surface conditioner is particularly insufficient in using a silica dispersant.

SUMMARY OF THE INVENTION

In view of the above-mentioned state of the art, it is an object of the present invention to provide a concentrated solution (liquid concentrate) for preparing a surface conditioner, a surface conditioner (a treatment solution in conditioning a surface), which have the excellent stability of dispersion and a method of a surface conditioning using this surface conditioner.

The present invention pertains to a concentrated solution for preparing a surface conditioner (a first concentrated solution for preparing a surface conditioner) containing zinc phosphate particles and having a pH of 3 to 12, wherein the above-mentioned zinc phosphate particles have $D_{50}$ of 3 μm or less and the above-mentioned concentrated solution for preparing a surface conditioner contains a laminar clay mineral.

In the above-mentioned concentrated solution for preparing a surface conditioner (first concentrated solution for preparing a surface conditioner), the above-mentioned laminar clay mineral is preferably a natural hectorite and/or a synthetic hectorite.

The present invention also pertains to a concentrated solution for preparing a surface conditioner (a second concentrated solution for preparing a surface conditioner) containing zinc phosphate particles and having a pH of 3 to 12, wherein the above-mentioned zinc phosphate particles have $D_{50}$ of 3 μm or less and the above-mentioned concentrated solution for preparing a surface conditioner contains a bentonite surface treated with alkyltrialkoxysilane expressed by the following formula (I);

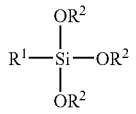

(I)

in the formula, $R^1$ is a saturated alkyl group having 1 to 22 carbon atoms, and $R^2$s are identical to or different from one another and a methyl, ethyl, propyl or butyl group.

The present invention also pertains to a surface conditioner (first surface conditioner) containing zinc phosphate particles and having a pH of 3 to 12, wherein the above-mentioned zinc phosphate particles have $D_{50}$ of 3 μm or less and the above-mentioned surface conditioner contains a laminar clay mineral.

In the above-mentioned surface conditioner (first surface conditioner), the above-mentioned laminar clay mineral is preferably a natural hectorite and/or a synthetic hectorite.

The present invention also pertains to a surface conditioner (a second surface conditioner) containing zinc phosphate particles and having a pH of 3 to 12, wherein the above-mentioned zinc phosphate particles have $D_{50}$ of 3 μm or less and the above-mentioned surface conditioner contains bentonite surface treated with alkyltrialkoxysilane expressed by the following formula (I);

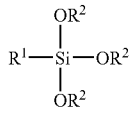

(I)

in the formula, $R^1$ is a saturated alkyl group having 1 to 22 carbon atoms, and $R^2$s are identical to or different from one another and a methyl, ethyl, propyl or butyl group.

The present invention also pertains to a method of a surface conditioning, comprising the step of bringing the above-mentioned surface conditioner (first and second surface conditioners) into contact with a metal surface.

DETAILED DESCRIPTION OF THE INVENTION

Figure 1:
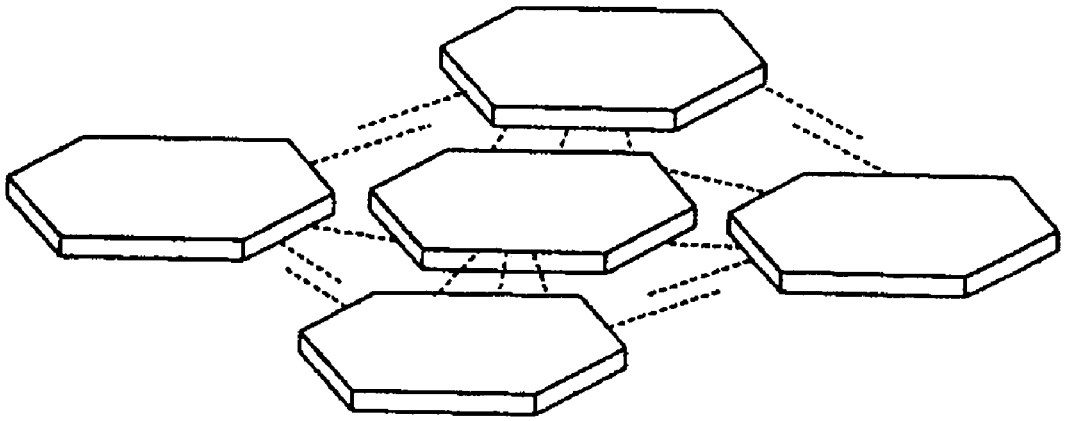
FIG. 1 is a schematic view of alkyltrialkoxysilane modified bentonite having a patchwork structure.

Hereinafter, the present invention will be described in detail.

A first and a second concentrated solutions for preparing a surface conditioner of the present invention are concentrated solutions (liquid concentrate) which are not yet adjusted by dilution to a first and a second surface conditioners to be described later, and generally solutions in a state of being stored before use (before a surface conditioning). The first and the second surface conditioners are generally prepared by diluting the above-mentioned first and second concentrated solutions for preparing a surface conditioner to a predetermined concentration.

The first concentrated solution (liquid concentrate) for preparing a surface conditioner of the present invention contains zinc phosphate particles having $D_{50}$ of 3 μm or less and a laminar clay mineral and has a pH of 3 to 12.

The first concentrated solution for preparing a surface conditioner of the present invention is formed by further blending a laminar clay mineral in the concentrated solution for preparing a surface conditioner containing zinc phosphate particles having $D_{50}$ of 3 μm or less. The above-mentioned laminar clay mineral is estimated to act as an anti-settling agent in the concentrated solution. Therefore, it not only prevents zinc phosphate particles in the first surface conditioner obtained by diluting the concentrated solution from precipitating but also prevents zinc phosphate particles in the concentrated solution from precipitating, and therefore it can retain the long-range stability of dispersion of the concentrated solution. By adding the laminar clay mineral, an excellent thickening effect can be exerted and repulsion of charged particles can be exerted by this addition. Accordingly, although the reason why the precipitation of the first concentrated solution for preparing a surface conditioner can be prevented is not clear, it is estimated that an extremely excellent effect of anti-settling of the zinc phosphate particles is exerted in virtue of this thickening effect in synergy with the repulsion of charged particles, and as a result of this, even in the concentrated solution, the precipitation of zinc phosphate particles can be more prevented and the long-range stability of dispersion can be retained.

And, the above-mentioned laminar clay mineral has electric repulsion per se. Thus, when the above laminar clay mineral adheres to circumferences of zinc phosphate particles, zinc phosphate particles in the first concentrated solution for preparing a surface conditioner can be stabilized by electric repulsion. Therefore, in preparation of the first concentrated solution (liquid concentrate) for preparing a surface conditioner, it is possible to attain finer zinc phosphate particles in dispersing the ingredients such as zinc phosphate particles in the solution and also to improve dispersion efficiency more.

The above laminar clay mineral is a silicate mineral or the like, having a laminar structure and a substance formed through lamination of many sheets (tetrahedral sheet constituted of silicic acid, octahedral sheet constructed by further containing Al, Mg or the like, etc.). By containing the above laminar clay mineral, it is possible to provide excellent stability of dispersion to the first concentrated solution for preparing a surface conditioner and also to improve dispersion efficiency.

The above laminar clay mineral is not particularly limited and can include a smectite group such as montmorillonite, beiderite, saponite, hectorite and the like; a kaolinite group such as kaolinite, hallosite and the like; a vermiculite group such as dioctahedral vermiculite, trioctahedral vermiculite and the like; micas such as taeniolite, tetrailicicmica, muscovite, illite, sericite, phlogopite, biotite and the like; hydrotalcite; pyrophyllolite; and laminar polysilicates such as kanemite, makatite, ilerite, magadiite, kenyaite and the like. These laminar clay minerals may be natural minerals or may be synthetic minerals by hydrothermal synthesis, a fusion method or a solid phase method.

And, intercalation compounds of the above laminar clay mineral (pillared crystal, etc.), a substance obtained by ion-exchanging the above laminar clay mineral and a substance obtained by applying surface treatment (treatment with a silane coupling agent, treatment by forming a composite with an organic binder) to the above laminar clay mineral can also be used. These laminar clay minerals may be used alone or in combination of two or more species.

Each of the above laminar clay mineral preferably has an average diameter (an average of maximum lengths) of 5 μm or less and more preferably an average diameter of 1 μm or less. When the average diameter is more than 5 μm, the stability of dispersion maybe deteriorated. And, an average aspect ratio (=an average of maximum length/minimum length) of the above laminar clay mineral is preferably 10 or more, more preferably 20 or more and furthermore preferably 40 or more. When it is less than 10, the stability of dispersion may be deteriorated.

The above laminar clay mineral is preferably a natural hectorite and/or a synthetic hectorite. This hectorite can impart the more excellent stability of dispersion to the first concentrated solution for preparing a surface conditioner and can improve the dispersion efficiency more.

The above-mentioned natural hectorite is a trioctahedral type clay mineral included in a montmorillonite group expressed by the following formula (II);

$$[Si_8(Mg_{5.34}Li_{0.66})O_{20}(OH)_4M^+_{0.66}.nH_2O] \quad (II)$$

As a commercially available product of the above natural hectorite, there can be given, for example, BENTON EW, BENTON AD (produced by ELEMENTIS PLC), etc.

The above-mentioned synthetic hectorite is a substance which is analogous to hectorite belonging to a trioctahedral mineral of an infinite layer expansion type having a crystal trilaminar structure and an expansive lattice and expressed by the following formula (III);

$$[[Si_8(Mg_aLi_b)O_{20}(OH)_cF_{4-c}]]^{X-}M^{X+} \quad (III)$$

wherein a, b and c satisfy the relationship of $0<a\leqq 6$, $0<b\leqq 6$, $4<a+b<8$, $0\leqq c<4$ and $x=12-2a-b$, and M is almost sodium. The synthetic hectorite comprises magnesium, silicon, sodium, as the main ingredients, and a trace of lithium and fluorine.

The above synthetic hectorite has a trilaminar structure and each layer of a crystal structure in the laminar structure consists of a two-dimensional platelet of about 1 nm in thickness. A lithium atom having a low valence isomorphically substitutes for a part of magnesium atoms existing in a middle layer of this platelet unit and therefore the platelet unit is negatively charged. In a dry condition, this negative charge balances with a displaceable cation present at the outside of a lattice structure in a plate plane and these particles are combined with one another by a Van der Waals force in a solid phase to form a bundle of plates.

When such synthetic hectorite is dispersed in a water phase, a displaceable cation is hydrated and particles cause swelling, and stable sol can be attained by dispersing the resulting particles using a usual dispersing machine such as a high-speed dissolver. In such a state of being dispersed in a water phase, the platelets bear negative charges on its surface, repel one another by virtue of their electrostatic and become stable sol which has been fractionized up to a primary particle of a platelet form. But, when a concentration of particles or a concentration of ions is increased, repulsion by virtue of negative charge on the surface is decreased and this allows an end portion of the platelet positively charged to be electrically oriented to a plate of another platelet negatively charged and forms the so-called card house structure, resulting in an increase in viscosity.

It is estimated that when the above synthetic hectorite is used, an excellent thickening property can be thus exerted and therefore it is possible to prevent zinc phosphate particles more from precipitating not only in the first surface conditioner obtained by diluting the concentrated solution but also in the concentrated solution and as a result of this it is possible to retain the long-range stability of dispersion of the concentrated solution more. And, it is estimated that since the zinc phosphate particles in the first concentrated solution for preparing a surface conditioner can be more stabilized, it is possible to attain finer zinc phosphate particles in dispersing the ingredients such as zinc phosphate particles and also to improve dispersion efficiency more.

As a commercially available product of the above synthetic hectorite, there can be given, for example, B, S, RD, RDS, XLG and XLS types of LAPONITE (trade name) series produced by Laporte Industries Ltd. These are white powder and readily form sol (S, RDS and XLS types of LAPONITE series) or gel (B, RD and XLG types of LAPONITE series) when added to water. In addition, there can also be given LUCENTITE SWN produced by CO-OP CHEMICAL Co., Ltd. These natural hectorite and synthetic hectorite may be used alone or in combination of two or more species.

In the above-mentioned first concentrated solution (liquid concentrate) for preparing a surface conditioner, a content of the above laminar clay minerals is preferably within a range of 0.1% by weight (lower limit) to 20% by weight (upper limit). When the content is less than 0.1% by weight, a sufficient effect of anti-settling of the zinc phosphate particles may not be attained. When it is more than 20% by weight, the concentrated solution becomes too viscous and a problem of handling that it becomes difficult to disperse the first concentrated solution (liquid concentrate) for preparing a surface conditioner or to draw a product out from a container may arise. More preferably, the above lower limit is 0.3% by weight and the above upper limit is 10% by weight.

The second concentrated solution (liquid concentrate) for preparing a surface conditioner of the present invention contains zinc phosphate particles having $D_{50}$ of 3 μm or less and bentonite surface treated with alkyltrialkoxysilane expressed by the above formula (I) and has a pH of 3 to 12. The above-mentioned second concentrated solution (liquid concentrate) for preparing a surface conditioner has an effect similar to the effect attained by adding a laminar clay mineral in the first concentrated solution for preparing a surface conditioner described above.

In alkyltrialkoxysilane expressed by the above formula (I), the above $R^1$ is a saturated alkyl group having 1 to 22 carbon atoms in the above formula (I). The above $R^1$ may be either straight-chain or branched. The above $R^2$s are identical to or different from one another and a methyl, ethyl, propyl or butyl group.

Surface treatment of the above-mentioned bentonite (montmorillonite) with alkyltrialkoxysilane is a treatment in which in purified bentonite, alkyltrialkoxysilane is added to a hydrophilic hydroxyl group existing in the surface of bentonite and makes the surface hydrophobic in part. Thereby, dispersed particles of modified bentonite which has been surface treated in an aqueous dispersion system are associated in virtue of a hydrophobic group to form a plastic structure, resulting in remarkable increase in apparent viscosity of the system.

That is, it is estimated that when bentonite (montmorillonite) surface treated with alkyltrialkoxysilane expressed by the above formula (I) is used in the above second concentrated solution for preparing a surface conditioner, an excellent thickening property can be exerted through the effect described above. It is also estimated that as a result of those mentioned above, it is possible to prevent zinc phosphate particles more from precipitating not only in the second surface conditioner obtained by diluting the concentrated solution but also in the concentrated solution and therefore it is possible to retain the long-range stability of dispersion of the concentrated solution more. And, it is estimated that since the zinc phosphate particles in the second concentrated solution for preparing a surface conditioner can be more stabilized, it is possible to attain finer zinc phosphate particles in dispersing the ingredients such as zinc phosphate particles and also to improve dispersion efficiency more.

As a commercially available product of the above-mentioned bentonite (montmorillonite) surface treated with alkyltrialkoxysilane expressed by the above formula (I), there can be given, for example, BEN-GEL-SH (produced by HOJUN Co., Ltd.).

The above-mentioned BEN-GEL-SH forms a patchwork structure as shown in FIG. 1 as distinct from a cardhouse structure which conventional montmorillonite forms in water. Since this patchwork structure is formed by associating laminar crystal particles of montmorillonite with a plane, it can exert an outstanding high viscosity. That is, among the above bentonite (montmorillonite) surface treated with alkyltrialkoxysilane expressed by the above formula (I), a substance having such a patchwork structure is particularly preferred because it exerts such effect more.

The bentonite surface treated with alkyltrialkoxysilane expressed by the above formula (I) (hereinafter, also referred to as "surface treated bentonite") preferably has an average diameter (an average of maximum lengths) of 5 μm or less and more preferably an average diameter of 1 μm or less. When the average diameter is more than 5 μm, the stability of dispersion may be deteriorated. And, an average aspect ratio (=an average of maximum length/minimum length) of the above surface treated bentonite is preferably 10 or more, more preferably 20 or more and furthermore preferably 40 or more. When it is less than 10, the stability of dispersion may be deteriorated.

In the above-mentioned second concentrated solution (liquid concentrate) for preparing a surface conditioner, a content of the above surface treated bentonite is preferably within a range of 0.1% by weight (lower limit) to 20% by weight (upper limit). When the content is less than 0.1% by weight, a sufficient effect of anti-settling of the zinc phosphate particles may not be attained. When it is more than 20% by weight, the concentrated solution becomes too viscous and a problem of handling that it becomes difficult to disperse the second concentrated solution (liquid concentrate) for preparing a surface conditioner or to draw a product out from a container may arises. More preferably, the above lower limit is 0.3% by weight and the above upper limit is 10% by weight.

Further, in the above first and second concentrated solution for preparing a surface conditioner, a dispersant may be further blended in addition to the laminar clay mineral and the surface treated bentonite, described above, within the limits of not inhibiting the effect of the present invention. The above-mentioned dispersant is not particularly limited and a polymer dispersant, a surfactant and a coupling agent, publicly known, can be given.

The first and the second concentrated solutions for preparing a surface conditioner of the present invention contain zinc phosphate particles having $D_{50}$ (diameter at 50% cumulative volume) of 3 μm or less. Since more crystal nuclei can be provided before applying chemical conversion treatment of phosphate by using the zinc phosphate particles having $D_{50}$ of 3 μm or less, fine phosphate crystals can be precipitated in a relatively short time of chemical conversion treatment. In addition, the above $D_{50}$ is an average dispersion diameter and an average particle diameter herein.

$D_{50}$ of the above-mentioned zinc phosphate particles is preferably within a range of 0.00 μm (lower limit) to 3 μm (upper limit). When the $D_{50}$ is less than 0.001 μm, particles may be flocculated due to a phenomenon of excessive dispersion. When it is more than 3 μm, the ratio of fine zinc phosphate particles may become small and it is improper. More preferably, the above lower limit is 0.005 μm and the above upper limit is 1 μm.

The above-mentioned first and second concentrated solutions for preparing a surface conditioner preferably contain zinc phosphate particles having $D_{90}$ (diameter at 90% cumulative volume) of 4 μm or less. In this case, since the above zinc phosphate particles have $D_{50}$ of 3 μm or less and in addition have $D_{90}$ of 4 μm or less, a portion of the zinc phosphate particles which coarse particles constitute is relatively small. As described above, fine phosphate crystals can be precipitated in a short time of chemical conversion treatment by using the zinc phosphate having $D_{50}$ of 3 μm or less, but when means of a mill or the like is employed in order to disperse the particles so as to be 3 μm or less, if the particles are excessively milled, an increased specific surface area causes shortages of the laminar clay mineral and the surface treated bentonite and overdispersed particles are flocculated to form coarse particles by contraries, resulting in the occurrence of a phenomenon of excessive dispersion impairing the stability of dispersion. Further, the formulation and the dispersion conditions of the first and the second concentrated solutions for preparing a surface conditioner generate the variation of dispersibility and coarse and fine particles, and cause the flocculation of particles and the increase in viscosity of a solution due to a close-packed structure resulting from coarse and fine particles and the mutual flocculation of fine particles. But, when the above $D_{90}$ (diameter at 90% cumulative volume) of zinc phosphate is 4 μm or less, such disadvantages can be protected.

$D_{90}$ of the above zinc phosphate particles is preferably within a range of 0.01 μm (lower limit) to 4 μm (upper limit). When the $D_{50}$ is less than 0.01 μm, particles may be flocculated due to a phenomenon of excessive dispersion. When it is more than 4 μm, the ratio of fine zinc phosphate particles may become small and it is improper. More preferably, the above lower limit is 0.05 μm and the above upper limit is 2 μm.

The above-mentioned $D_{50}$ (diameter at 50% cumulative volume) and $D_{90}$ (diameter at 90% cumulative volume) are particle diameters at points, respectively, which a cumulative curve reaches 50% and 90% when a cumulative curve is determined assuming that the total volume of all particles is 100% based on a particle size distribution in a dispersion. The above $D_{50}$ and $D_{90}$ can be automatically measured by using a particle size measuring apparatus such as a laser Doppler type particle size analyzer (Microtrac UPA 150 manufactured by NIKKISO CO., LTD.).

The above zinc phosphate particles are not particularly limited as long as its $D_{50}$ is 3 μm or less. And they may be a mixture of particles satisfying the condition that $D_{50}$ is 3 μm or less.

Each of the above-mentioned first and second concentrated solutions (liquid concentrates) for preparing a surface conditioner preferably has a zinc phosphate particles content of 3% by weight (lower limit) to 60% by weight (upper limit). In the case the content is less than 3% by weight, phosphate to become a crystal nuclei may be insufficient and a sufficient effect of a surface conditioning may not be attained when conducting a surface conditioning with the first or the second surface conditioner obtained from the concentrated solutions. Further, since a large amount of the concentrated solution is required in order to retain the zinc phosphate concentration required in a surface conditioning bath, workability is low and further it may be uneconomical. When the content is more than 60% by weight, the stability of dispersion of zinc phosphate particles in the first and the second concentrated solution for preparing a surface conditioner may be lowered and particles may be precipitated. More preferably, the above lower limit is 5% by weight and the above upper limit is 50% by weight.

The above first and second concentrated solutions for preparing a surface conditioner preferably contain a bivalent or trivalent metal nitrite compound. Since the surface conditioning is usually applied to a clean metal surface after degreasing and rinsing, problems such as oxidation or corrosion of the metal surface may occur during a surface conditioning step, but when the concentrated solutions contain a bivalent or trivalent metal nitrite compound, the formation of rust on the metal surface after the surface conditioning can be adequately suppressed. As a result of suppression of rust, a chemically converting property in a chemical conversion treatment can be greatly improved.

The above-mentioned bivalent or trivalent metal nitrite compound is not particularly limited as long as it is nitrite containing bivalent or trivalent metal, and for example, zinc nitrite, copper nitrite, nickel nitrite, and alkaline earth metal nitrite such as magnesium nitrite, calcium nitrite, strontium nitrite, barium nitrite and the like can be given. Among others, zinc nitrite is preferred. When zinc nitrite is used in a surface conditioning, a bath control of a chemical conversion treatment solution become easy since zinc nitrite prevents a heterogeneous metal from accumulating in a chemical conversion treatment bath during forming a chemical conversion coat of zinc phosphate in a chemical conversion treatment step. And, the formation of rust on the metal surface after the surface conditioning can be more suppressed. These may be used alone or in combination of two or more species.

Each of the above first and second concentrated solutions (liquid concentrates) for preparing a surface conditioner preferably has a bivalent or trivalent metal nitrite compound content of 0.1% by weight (lower limit) to 10% by weight (upper limit). When the content is less than 0.1% by weight, the rust-preventive property and the metal substitution of the first and the second surface conditioner obtained from the concentrated solutions may not be well found. When the content is more than 10% by weight, in the case of using a metal nitrite compound, a cationic component in the metal nitrite compound may inhibit the dispersibility and it may also be uneconomical. More preferably, the above lower limit is 0.5% by weight and the above upper limit is 5% by weight.

The above first and second concentrated solutions (liquid concentrate) for preparing a surface conditioner may contain a dispersing medium to disperse zinc phosphate particles. As the above-mentioned dispersing medium, there is given a water-borne medium, and in addition various organic solvents can be used as a medium other than water. In accordance with the present invention, there can be used a dispersion solution not containing any dispersing medium other than water.

A water-soluble organic solvent is not particularly limited and alcoholic solvents such as methanol, isopropanol, ethylene glycol, ethylene glycol monopropyl ether and the like; hydrocarbon solvents such as hexane, heptane, xylene, toluene, cyclohexane, naphtha and the like; ketonic solvents such as methyl isobutyl ketone, methyl ethyl ketone, isophorone, acetophenone and the like; amide solvents such as dimethylacetamide, methyl pyrrolidone, and the like; and ester solvents such as ethyl acetate, isobutyl acetate, octyl acetate, ethylene glycol acetate monomethyl ether, diethylene glycol acetate monomethyl ether and the like can be given. These may be used alone or in combination of two or more species.

A thickener may be added to the above first and second concentrated solutions for preparing a surface conditioner as required in order to further improve the stability.

The above-mentioned thickener is not particularly limited and inorganic thickeners such as kaolin, diatomaceous earth, calcium carbonate, barium sulfate, titanium oxide, alumina white, silica, aluminum hydroxide and the like, organic thickeners such as polyacrylic ester, polyurethane, polyester, polyethylene, polypropylene, polyvinyl chloride, polyvinylidene chloride, polystyrene, polysiloxane, polysaccharide thickener, phenol resin, epoxy resin, benzoguanamine resin and the like or thickeners containing polymer thereof can be given. Further, the above organic thickener may be added within the limits of not inhibiting the effect of the present invention. These may be used alone or in combination of two or more species.

An alkaline salt such as soda ash may be added to the above first and second concentrated solutions for preparing a surface conditioner for the purpose of further stabilizing the zinc phosphate particles and forming a fine chemical conversion coat in a subsequent chemical conversion treatment step of a phosphate coat.

The above first and second concentrated solutions for preparing a surface conditioner have a pH of 3 (lower limit) to 12 (upper limit), respectively. When the pH is less than 3, zinc phosphate particles become apt to dissolve and unstable and this may have an effect on a subsequent step. When it is more than 12, this results in the reduction of pH in a chemical conversion bath of the subsequent step and therefore an effect of a chemical conversion defect may be found. Preferably, the above lower limit is 6 and the above upper limit is 11.

The first and the second surface conditioners of the present invention allows fine particles of zinc phosphate to adhere to a metal surface through their uses in a surface conditioning which is pretreatment of chemical conversion treatment of a phosphate coat and promotes formation of a zinc phosphate coat using the above fine particles as the crystal nucleus in a step of chemical conversion treatment of zinc phosphate to form a good zinc phosphate coat. When chemical conversion treatment is performed after conducting a surface conditioning of metal material using this function of pretreatment, it is possible to precipitate fine phosphate crystals in a relatively short time of chemical conversion treatment and to cover a whole metal surface with the precipitated crystals. These surface conditioners can be obtained, for example, by diluting the above-mentioned first and second concentrated solutions for preparing a surface conditioner to adjust the concentrated solutions to a predetermined concentration.

The first surface conditioner of the present invention contains zinc phosphate particles having $D_{50}$ of 3 μm or less and laminar clay minerals and has a pH of 3 to 12. Therefore, the above first surface conditioner has the excellent stability of dispersion. The laminar clay minerals contained in the above first surface conditioner are similar to the laminar clay minerals contained in the above first concentrated solution for preparing a surface conditioner.

The second surface conditioner of the present invention contains zinc phosphate particles having $D_{50}$ of 3 μm or less and bentonite surface treated with alkyltrialkoxysilane expressed by the above formula (I) and has a pH of 3 to 12. Therefore, the above second surface conditioner has the excellent stability of dispersion. The surface treated bentonite contained in the above second surface conditioner is similar to the surface treated bentonite contained in the above second concentrated solution for preparing a surface conditioner.

The zinc phosphate particles contained in the above first and second surface conditioners are also similar to the zinc phosphate particles contained in the above first and second concentrated solutions for preparing a surface conditioner. The above first and second surface conditioners may contain a bivalent or trivalent metal nitrite compound, a dispersant, a dispersing medium and a thickener which are similar to those in the above first and second concentrated solutions for preparing a surface conditioner.

In the above-mentioned first surface conditioner, a content of the above laminar clay minerals is preferably within a range of 3 ppm (lower limit) to 600 ppm (upper limit). When the content is less than 3 ppm, a sufficient effect of anti-settling of the zinc phosphate particles in the first surface conditioner may not be attained. When it is more than 600 ppm, adsorption of the clay minerals to a metal surface may occur and this adsorption may have an effect on a subsequent chemical conversion treatment step. More preferably, the above lower limit is 10 ppm and the above upper limit is 450 ppm.

In the above-mentioned second surface conditioner, a content of the above surface treated bentonite is preferably within a range of 3 ppm (lower limit) to 600 ppm (upper limit). When the content is less than 3 ppm, a sufficient effect of anti-settling of the zinc phosphate particles in the second surface conditioner may not be attained. When it is more than 600 ppm, adsorption of the bentonite to a metal surface may occur and this adsorption may have an effect on a subsequent chemical conversion treatment step. More preferably, the above lower limit is 10 ppm and the above upper limit is 450 ppm.

Each of the above first and second surface conditioners preferably has a zinc phosphate particles content of 50 ppm (lower limit) to 20000 ppm (upper limit). When the content is less than 50 ppm, phosphate to become crystal nuclei may be insufficient and a sufficient effect of a surface conditioning may not be attained. Since even when the content is more than 20000 ppm, an effect exceeding the desired effect is not attained, it is uneconomical. More preferably, the above lower limit is 150 ppm and the above upper limit is 10000 ppm.

Each of the above first and second surface conditioners preferably has a bivalent or trivalent metal nitrite compound content of 20 ppm (lower limit) to 1000 ppm (upper limit). When the content is less than 20 ppm, the rust-preventive property and the metal substitution of the first and the second surface conditioners may not be well found. And, phosphate to become crystal nuclei may be insufficient and a sufficient effect of a surface conditioning may not be attained. When it is more than 1000 ppm, since it is necessary to add a large amount of an alkaline component such as caustic soda in the first and the second surface conditioners, it is uneconomical. More preferably, the above lower limit is 40 ppm and the above upper limit is 300 ppm.

The above first and second surface conditioners have a pH of 3 (lower limit) to 12 (upper limit), respectively. When the pH is less than 3, zinc phosphate particles become apt to dissolve and unstable and this may have an effect on a subsequent step. When it is more than 12, this results in the reduction of pH in a chemical conversion bath of the subsequent step and therefore an effect of a chemical conversion defect may be found. Preferably, the above lower limit is 6 and the above upper limit is 11.

The first and the second concentrated solutions for preparing a surface conditioner and the first and the second surface conditioners of the present invention can be produced, for example, by the following method.

The above zinc phosphate particles can be obtained by using, for example, zinc phosphate to be used as a raw material. Zinc phosphate of a raw material is one expressed by $Zn_3(PO_4)_2.4H_2O$ and generally a colorless crystalline solid, but a white powdery commercial product is available.

As a method of producing the above zinc phosphate of a raw material, there is given, for example, a method in which a tetrahydrate of zinc phosphate is produced as a crystalline precipitation by mixing zinc sulfate and a diluent of disodium hydrogenphosphate in a molar ratio of 3:2 and heating the mixture. And, a tetrahydrate of zinc phosphate can also be produced by reacting a dilute aqueous solution of phosphoric acid with zinc oxide or zinc carbonate. A crystal of tetrahydrate is a rhombic system and has three transformations. When the crystal is heated, it becomes dihydrate at 100° C., monohydrate at 190° C., and anhydride at 250° C. As zinc phosphate in the present invention, any of these tetrahydrate, dihydrate, monohydrate or anhydride is applicable, but it is adequate to use tetrahydrate, which is generally available, as-is.

And, as the above zinc phosphate of a raw material, substances to which various surface treatments are applied may be used. For example, zinc phosphate surface treated with a silane coupling agent, rosin, a silicone compound, or metal alkoxide such as silicon alkoxide and aluminum alkoxide may be used.

It is known that zinc phosphate brought into fine particles can be obtained by adding silica and polyphosphoric acid in reacting a zinc compound with phosphoric acid from Japanese Kokoku Publication Sho-49-2005, and that metals such as magnesium, calcium, aluminum, etc. can be substituted for part of zinc in zinc phosphate by wet-kneading zinc phosphate and various metal compounds with a mechanical means and completing a reaction mechnochemically from Japanese Kokai Publication Hei-4-310511, and zinc phosphate in which any of components such as silica, calcium and aluminum other than phosphorus, oxygen and zinc is introduced by such a means or a substance which is commercially available as silicic acid modified zinc phosphate may be used. In this case, it is preferred that these substance contain zinc phosphate in an amount of 25% by weight or more on a base of ZnO and 15% by weight or more on a base of $P_2O_5$.

A configuration of the above zinc phosphate of a raw material is not particularly limited and any form of zinc phosphate can be used. A-commercial product is generally white and powdery, but the powder in any form, such as a fine particle, a plate, a scale, etc., may be used. A particle diameter of the above zinc phosphate of a raw material is also not particularly limited, but an average particle diameter is generally on the order of several μm. Particularly, substances commercially available as rust-preventive pigment such as products of which buffering actions are enhanced by applying a treatment for providing a basic property are suitably employed. Since a stable dispersion, in which zinc phosphate particles are dispersed finely, can be prepared in the present invention as described later, a stable effect of surface treatment can be attained without being affected by a primary particle diameter and a form as zinc phosphate of a raw material.

It is preferred to use the zinc phosphate of a raw material which has been fractionated finely by previously bringing the zinc phosphate of a raw material into a dispersion. A method of preparing a water-borne dispersion, formed by dispersing the zinc phosphate particles in a water-borne medium, is not limited, but preparation of the water-borne dispersion can be attained preferably by blending the zinc phosphate of a raw material in the above-mentioned medium such as water or an organic solvent and wet-milling in the presence of the laminar clay mineral and the surface treated bentonite, described above. Further, on the occasion of obtaining the water-borne dispersion of zinc phosphate particles, it is favorable for a process to blend the zinc phosphate of a raw material in the water-borne medium in preparing a dispersion and to conduct wet-milling, but the water-borne dispersion of zinc phosphate particles may be prepared by conducting solvent substitution after conducting wet-milling in a dispersing medium other than the water-borne medium.

In the above-mentioned preparation of the water-borne dispersion, it is preferred that an amount of the above zinc phosphate of a raw material to be blended is generally within a range of 0.5% by weight (lower limit) to 50% by weight (upper limit) with respect to 100% by weight of a dispersion. When this amount is less than 0.5% by weight, a sufficient effect of the first and the second surface conditioner obtained by using the dispersion may not be attained since the content of zinc phosphate is too small. When it is more than 50% by weight, it may become difficult to yield a uniform and fine particle size distribution and to form a state of fine dispersion by wet-milling. More preferably, the above lower limit is 1% by weight and the above upper limit is 40% by weight.

Further, in the above preparation of the water-borne dispersion, it is preferred that an amount of the above laminar clay mineral or the above surface treated bentonite to be added is within a range of 0.1% by weight (lower limit) to 30% by weight (upper limit) with respect to 100% by weight of the dispersion. When this amount is less than 0.1% by weight, dispersibility may be insufficient. When it is more than 30% by weight, dispersibility may become poor due to an interaction between excessive laminar clay minerals or excessive surface treated bentonite, and even when the dispersibility is sufficient, it is economically disadvantageous. More preferably, the above lower limit is 0.5% by weight and the above upper limit is 20% by weight.

A method of obtaining a dispersion, in which the above zinc phosphate particles are dispersed finely in such a way that $D_{50}$ of the zinc phosphate particles is 3 μm or less, is not limited, but it is preferred that zinc phosphate of a raw material is added to a dispersing medium so as to exist at the content of 0.5 to 50% by weight, and the laminar clay mineral or the surface treated bentonite is added to the dispersing medium so as to exist at the content of 0.1 to 30% by weight and the resulting mixture is wet-milled. A method of the above-mentioned wet-milling is not particularly limited and usual means of wet-milling may be employed, and for example, a beads mill represented by, for example, a disc type and a pin type and a medialess disperser represented by a high pressure homogenizer and an ultrasonic disperser may be used.

In the above wet-milling, by monitoring $D_{90}$ of the zinc phosphate particles, phenomenon of excessive dispersion and phenomena of the flocculation of particles, the increase in viscosity of a solution and the mutual flocculation of fine particles can be prevented. In the present invention, it is preferred to adjust $D_{90}$ to 4 μm or less. And it is desirable to select the formulation and the dispersion conditions of the level of not producing excessive dispersion.

By a method of preparing a dispersion described above, it is possible to adjust $D_{50}$ of zinc phosphate in the water-borne medium to 3 μm or less and to obtain the water-borne dispersion having the excellent stability and having the excellent performance as the first and the second surface conditioner. $D_{50}$ can be generally adjusted to a desired extent within a range of 0.01 to 3 μm.

It is possible to disperse zinc phosphate in a state that $D_{50}$ is 3 μm or less in a solution even though a particle diameter of zinc phosphate is 3 μm or more by preparing the water-borne dispersion according to the method of preparing a dispersion described above. The same holds true with regard to zinc phosphate having a primary particle diameter of several tens μm. This also means that a primary particle diameter of pigment can be reduced by wet milling according to the method described above even though zinc phosphate originally having a small primary particle diameter is not used. In accordance with the above method, the $D_{50}$ of zinc phosphate particles in the water-borne dispersion can also be adjusted to 3 μm or less, further 1 μm or less, and furthermore 0.2 μm or less.

The dispersion thus obtained is a water-borne dispersion which can adjust $D_{50}$ of zinc phosphate particles in a solution to 3 μm or less in conformity with use and has the excellent stability of dispersion and can exert the excellent performance when by using this, the first and the second surface conditioners are prepared.

Since a portion of coarse particles, which are represented as a particle having a particle diameter exceeding $D_{90}$, can be reduced by the above wet milling process, it is possible to prepare a dispersion particularly having a narrow distribution of a dispersion diameter in which large dispersion diameters are restricted such as $D_{90}$ of 4 μm or less, further 2.6 μm or less, furthermore 0.3 μm or less as a distribution of dispersion diameters. Thus, it is estimated that the zinc phosphate is dispersed with fine dispersion diameters and has an extremely stable dispersion condition. Further, it is estimated from a small portion of coarse particles that the zinc phosphate in a solution efficiently contributes to produce crystal nuclei, estimated from a narrow distribution of a dispersion diameter and uniform particle diameters that in a surface conditioning step, more uniform crystal nuclei are formed to provide the formation of uniform zinc phosphate crystals by a subsequent chemical conversion treatment and therefore surface properties of the resulting steel sheet subjected to chemical conversion treatment become homogeneous and excellent, and estimated that this improves treating properties for pockets of members having a complicated structure or a steel sheet such as black coat steel, which is difficult to be chemical conversion treated.

In addition, the $D_{50}$ and $D_{90}$ of zinc phosphate in a dispersion can be determined by measuring a particle size distribution using a laser Doppler type particle size analyzer.

With respect to the above water-borne dispersion, it is also possible to attain a high concentration of water-borne dispersion in which particularly, zinc phosphate is blended in an amount 10% by weight or more, further 20% by weight or more, and furthermore 30% by weight or more. Therefore, the first and the second surface conditioners exhibiting high performance can be readily prepared.

The first and the second concentrated solutions for preparing a surface conditioner and the first and the second surface conditioners of the present invention can be prepared, for example, by mixing the water-borne dispersion obtained in a manner described above and other components (laminar clay minerals, bivalent or trivalent metal nitrite compounds, a dispersing medium and a thickener). A method of mixing the above water-borne dispersion and the above other components is not particularly limited and for example, a method of adding the other components to the water-borne dispersion and then mixing may be employed, or a method of blending the other components in the water-borne dispersion under being prepared may be employed.

A method of a surface conditioning of the present invention comprises the step of bringing the above-mentioned surface conditioner (first and second surface conditioners) into contact with a metal surface. This allows fine particles of zinc phosphate to adhere well to a metal surface such as iron base, zinc base and aluminum base metal and a good chemical conversion coat to be formed in a step of chemical conversion treating.

A method of bringing the first or the second surface conditioner into contact with a metal surface in the above-mentioned method of a surface conditioning is not particularly limited and conventional methods publicly known, such as immersion, spraying, etc., can be appropriately employed.

Metal materials, to which the above-mentioned surface conditioning is applied, are not particularly limited and the surface conditioning can be applicable to various materials to which the chemical conversion treatment of phosphate is generally applied, for example, steel, galvanized steel sheet, aluminum or aluminum alloy and magnesium alloy.

And, it is possible to use the first and the second surface conditioners of the present invention for a step of degreasing and surface conditioning. Thereby, a rinsing step after degreasing can be omitted. In order to enhance detergency, publicly known inorganic alkali builders, organic builders and surfactants may be added in the above degreasing and surface conditioning. And, publicly known chelate agent and condensed phosphate may be added. In the above surface conditioning, a contact time between the first and the second surface conditioners and the metal surface and a temperature of the first and the second surface conditioners are not particularly limited and publicly known conditions can be employed.

It is possible to manufacture a steel sheet chemical conversion treated with phosphate by conducting the above surface conditioning and then conducting chemical conversion treatment of phosphate.

A method of the above chemical conversion treatment of phosphate is not particularly limited and various publicly known method such as dipping, spraying, electroplating, etc. can be applied. These methods may be used in combination. With respect to a phosphate coat to be precipitated, it is not particularly limited as long as it is phosphate, and zinc phosphate, iron phosphate, manganese phosphate, and zinc calcium phosphate are not restricted at all. In the above chemical conversion treatment of phosphate, a contact time between a chemical conversion treatment agent and the metal surface and a temperature of a chemical conversion treatment agent are not particularly limited and publicly known conditions can be employed.

It is possible to manufacture a coated steel sheet by further coating after conducting the above surface conditioning and the above chemical conversion treatment. As a method of the above coating, an electrodeposition is popular. Coating compositions to be used in coating are not particularly limited and various coating compositions generally used in coating a steel sheet chemical conversion treated with phosphate, for example epoxy melamine coating composition, cationic electrocoating composition, polyester intermediate coating composition, polyester top coating composition, etc. can be given. In addition, a publicly known method that a cleaning step is performed prior to coating is employed after chemical conversion treatment.

The first concentrated solution for preparing a surface conditioner of the-present invention contains zinc phosphate particles having $D_{50}$ of 3 μm or less and laminar clay mineral and has a pH of 3 to 12. And, the second concentrated solution for preparing a surface conditioner of the present invention contains zinc phosphate particles having $D_{50}$ of 3 μm or less and bentonite surface treated and has a pH of 3 to 12. Therefore, not only the stability of dispersion of the first and the second surface conditioners obtained by diluting the first and the second concentrated solutions for preparing a surface conditioner but also the stability of dispersion of the concentrated solutions (liquid concentrate) is excellent. And, it is possible to attain finer zinc phosphate particles and also to improve dispersion efficiency more. This concentrated solution is also superior in the stability of dispersion in a bath because of containing zinc phosphate particles having $D_{50}$ of 3 μm or less. Accordingly, the first and the second surface conditioners obtained by diluting the above first and second concentrated solutions for preparing a surface conditioner can be suitably used for various metal materials.

Since the first and the second concentrated solutions for preparing a surface conditioner of the present invention are constructed as described above, not only the stability of dispersion of the first and the second surface conditioners obtained by diluting the first and the second concentrated solutions for preparing a surface conditioner but also the stability of dispersion of the concentrated solutions (liquid concentrate) are excellent. Accordingly, the first and the second surface conditioners obtained from the above concentrated solutions can be suitably used for various metal materials.

BEST MODES FOR CARRYING OUT THE INVENTION

Hereinafter, the present invention will be described in more detail by way of examples, but the present invention is not limited to these examples. In addition, "part(s)" and "%" refer to "part(s) by weight" and "% by weight" in Examples, unless otherwise specified.

EXAMPLE 1

Production of a Concentrated Solution (Liquid Concentrate) for Preparing a Surface Conditioner and Production of a Surface Conditioner Natural hectorite "BENTON EW" (produced by ELEMENTIS PLC) 2 parts by weight was added to 86 parts by weight of water and this mixture was stirred for 30 minutes at a rotational speed of 3000 rpm using a disper to obtain pre-gel. To the resulting pre-gel, 2 parts by weight of a dispersant and 10 parts by weight of zinc phosphate particles were added, and zinc phosphate particles in this mixture were dispersed with zirconia beads until a predetermined viscosity was reached to obtain a concentrated solution for preparing a surface conditioner (concentration of zinc phosphate particles 10% by weight, concentration of natural hectorite 2% by weight).

Further, the resulting concentrated solution was diluted with water and-the diluted solution was adjusted to pH 9.5 with caustic soda to obtain a surface conditioner (concentration of zinc phosphate particles 1500 ppm, concentration of natural hectorite 300 ppm).

EXAMPLE 2

Production of a Concentrated Solution (Liquid Concentrate) for Preparing a Surface Conditioner and Production of a Surface Conditioner A concentrated solution for preparing a surface conditioner was obtained by following the same procedure as in Example 1 except for changing the amount of "BENTON EW" added to 1 parts by weight (concentration of zinc phosphate particles 10% by weight, concentration of natural hectorite 1% by weight) Further, a surface conditioner was obtained (concentration of zinc phosphate particles 1500 ppm, concentration of natural hectorite 150 ppm).

EXAMPLE 3

Production of a Concentrated Solution (Liquid Concentrate) for Preparing a Surface Conditioner and Production of a Surface Conditioner A concentrated solution for preparing a surface conditioner was obtained by following the same procedure as in Example 1 except for using 3 parts by weight of "LAPONITE RD" (produced by Laporte Industries Ltd.), synthetic hectorite, in place of 2 parts by weight of "BENTON EW" (concentration of zinc phosphate particles 10% by weight, concentration of synthetic hectorite 3% by weight). Further, a surface conditioner was obtained (concentration of zinc phosphate particles 1500 ppm, concentration of synthetic hectorite 450 ppm).

EXAMPLE 4

Production of a Concentrated Solution (Liquid Concentrate) for Preparing a Surface Conditioner and Production of a Surface Conditioner A concentrated solution for preparing a surface conditioner was obtained by following the same procedure as in Example 1 except for using 3 parts by weight of "BENGEL-SH" (produced by HOJUN Co., Ltd.), alkylalkoxysilane modified bentonite, in place of 2 parts by weight of "BENTON EW" (concentration of zinc phosphate particles 10% by weight, concentration of alkylalkoxysilane modified bentonite 3% by weight). Further, a surface conditioner was obtained (concentration of zinc phosphate particles 1500 ppm, concentration of alkylalkoxysilane modified bentonite 450 ppm)

COMPARATIVE EXAMPLE 1

Production of a Concentrated Solution (Liquid Concentrate) for Preparing a Surface Conditioner and Production of a Surface Conditioner A concentrated solution for preparing a surface conditioner was obtained by following the same procedure as in Example 1 except that "BENTON EW" was not added (concentration of zinc phosphate particles 10% by weight). Further, a surface conditioner was obtained (concentration of zinc phosphate particles 1500 ppm).

COMPARATIVE EXAMPLE 2

Production of a Concentrated Solution (Liquid Concentrate) for Preparing a Surface Conditioner and Production of a Surface Conditioner A concentrated solution for preparing a surface conditioner was obtained by following the same procedure as in Example 1 except for using 0.5 parts by weight of carboxymethylcellulose (CMC) in place of 2 parts by weight of "BENTON EW" (concentration of zinc phosphate particles 10% by weight, concentration of CMC 0.5% by weight) Further, a surface conditioner was obtained (concentration of zinc phosphate particles 1500 ppm, concentration of CMC 75 ppm).

COMPARATIVE EXAMPLE 3

Production of a Concentrated Solution (Liquid Concentrate) for Preparing a Surface Conditioner and Production of a Surface Conditioner A concentrated solution for preparing a surface conditioner was obtained by following the same procedure as in Example 1 except for using 2 parts by weight of polyacrylic acid in place of 2 parts by weight of "BENTON EW" (concentration of zinc phosphate particles 10% by weight, concentration of polyacrylic acid 2% by weight) Further, a surface conditioner was obtained (concentration of zinc phosphate particles 1500 ppm, concentration of polyacrylic acid 300 ppm).

COMPARATIVE EXAMPLE 4

Production of a Concentrated Solution (Liquid Concentrate) for Preparing a Surface Conditioner and Production of a Surface Conditioner A concentrated solution for preparing a surface conditioner was obtained by following the same procedure as in Example 1 except for using 3 parts by weight of "AEROSIL#300" (produced by Nippon Aerosil Co., Ltd.), silica, in place of 2 parts by weight of "BENTON EW" (concentration of zinc phosphate particles 10% by weight, concentration of silica 3% by weight). Further, a surface conditioner was obtained (concentration of zinc phosphate particles 1500 ppm, concentration of silica 450 ppm).

[Evaluation Test]

Evaluation tests were performed according to the following methods. The results are shown in Table 1.

Stability of a Concentrated Solution (Liquid Concentrate) for Preparing a Surface Conditioner Each of the concentrated solutions for preparing a surface conditioner obtained in Examples and Comparative Examples was left alone in the conditions of (1) at room temperature in a room, (2) at 5° C. in a refrigerator and (3) at 40° C. in a incubator, respectively, and its stability was visually determined after a lapse of 3 months according to the following criteria.

○; Appearance is uniform.

Δ; Supernatant liquid is slightly observed.

×; Concentrated solution is thoroughly separated into two phases, precipitated or decayed.

Stability of a Surface Conditioner (Bath Stability in a Surface Conditioning)

To the surface conditioners, obtained in Examples and Comparative Examples, $Ca(NO_3)_2.4H_2O$ and $Mg(NO_3)_2.6H_2O$ were added so as to be 20 ppm, respectively, on a base of Ca or Mg (metal) and left alone, and set in a thermostat of 50° C. to perform a secular stability acceleration test. Each sample was evaluated according to the following criteria.

○; State of dispersion is good.

×; Zinc phosphate particles are flocculated or decayed.

Measurement of a Particle Diameter of Zinc Phosphate Particles

Particle size distribution of each sample was measured using laser scattering particle size distribution analyzer ("LA-500" manufactured by HORIBA, Ltd.), and $D_{50}$ (an average diameter of dispersed matter) and $D_{90}$ were monitored and measured.

TABLE 1

| | Component of addition | | | | Stability (3 months) of concentrated solution (liquid concentrate) | | | Bath stability |
|---|---|---|---|---|---|---|---|---|
| | Structure or material name and concentration | Trade name | $D_{50}$ | $D_{90}$ | Room temperature (20° C.) | 5° C. | 40° C. | of surface conditioner |
| Example 1 | Natural hectorite 2% | BENTON EW | 0.49 μm | 0.88 μm | ○ | ○ | ○ | ○ |
| Example 2 | Natural hectorite 1% | BENTON EW | 0.54 μm | 1.13 μm | ○ | ○ | ○ | ○ |
| Example 3 | Synthetic hectorite 3% | LAPONITE RD | 0.57 μm | 1.12 μm | ○ | ○ | ○ | ○ |
| Example 4 | Bentonite produced by an organic monomer reaction 3% | BEN-GEL-SH | 0.51 μm | 0.98 μm | ○ | ○ | ○ | ○ |
| Comparative Example 1 | None | | 0.66 μm | 1.26 μm | X Precipitation | X Precipitation | X Precipitation | ○ |
| Comparative Example 2 | CMC (carboxymethylcellulose) 0.5% | | 0.65 μm | 1.24 μm | ○ | ○ | X Decay | X Decay |
| Comparative Example 3 | Polyacrylic acid polymer 2% | | 0.50 μm | 0.91 μm | X Precipitation | X Precipitation | X Precipitation | ○ |
| Comparative Example 4 | Silica 3% | AEROSIL #300 | 0.51 μm | 0.99 μm | X Precipitation | X Precipitation | X Precipitation | ○ |

In Examples both the stability of the concentrated solutions for preparing a surface conditioner and the stability of the surface conditioners were excellent. And, the surface conditioners of Examples had finer particle diameters ($D_{50}$) of zinc phosphate particles than that of Comparative Example 2.

The surface conditioner of the present invention can be suitably used for various metal materials which are used in automobile's bodies, household electrical appliances and the like.

What is claimed is:

1. A concentrated solution for preparing a surface conditioner containing zinc phosphate particles and having a pH of 3 to 12, wherein said zinc phosphate particles have $D_{50}$ of 3 μm or less and comprise 3 to 60% by weight of said concentrated solution; and said concentrated solution for preparing a surface conditioner contains 0.1 to 20% by weight of a laminar clay mineral, said laminar clay material being a natural hectorite and/or a synthetic hectorite.

2. A concentrated solution for preparing a surface conditioner containing zinc phosphate particles and having a pH of 3 to 12, wherein said zinc phosphate particles have $D_{50}$ of 3 μm or less and comprise 3 to 60% by weight of said concentrated solution; and said concentrated solution for preparing a surface conditioner contains 0.1 to 20% by weight of a bentonite surface treated with alkyltrialkoxysilane expressed by the following formula (I);

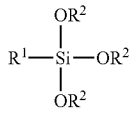

(I)

in the formula (I), $R^1$ is a saturated alkyl group having 1 to 22 carbon atoms, and $R^2$s are identical to or different from one another, each $R^2$ being and a methyl, ethyl, propyl or butyl group.

3. A surface conditioner containing zinc phosphate particles and having a pH of 3 to 12, wherein said zinc phosphate particles have $D_{50}$ of 3 μm or less and comprise 50 to 20000 ppm of said surface conditioner; and said surface conditioner contains 3 to 600 ppm of a laminar clay mineral, said laminar clay mineral being a natural hectorite and/or a synthetic hectorite.

4. A surface conditioner containing zinc phosphate particles and having a pH of 3 to 12, wherein said zinc phosphate particles have $D_{50}$ of 3 μm or less and comprise 50 to 20000 ppm of said surface conditioner; and said surface conditioner contains 3 to 600 ppm of bentonite surface treated with alkyltrialkoxysilane expressed by the following formula (I);

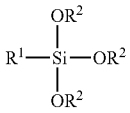

(I)

in the formula (I), $R^1$ is a saturated alkyl group having 1 to 22 carbon atoms, and $R^2$s are identical to or different from one another, each $R^2$ being a methyl, ethyl, propyl or butyl group.

5. A method of surface conditioning comprising bringing the surface conditioner according to claim 3 or claim 4 into contact with a metal surface.

* * * * *

UNITED STATES PATENT AND TRADEMARK OFFICE

CERTIFICATE OF CORRECTION

PATENT NO. : 7,208,054 B2
APPLICATION NO. : 11/062252
DATED : April 24, 2007
INVENTOR(S) : Toshiko Nakazawa It is certified that error appears in the above-identified patent and that said Letters Patent is hereby corrected as shown below:

Column 20, lines 52-53, delete "each $R^2$ being and a methyl, ethyl, propyl or butyl group" and substitute -- each $R^2$ being a methyl, ethyl, propyl or butyl group --

Signed and Sealed this

Eighteenth Day of September, 2007

JON W. DUDAS
*Director of the United States Patent and Trademark Office*